United States Patent [19]

Cohen et al.

[11] Patent Number: 4,467,296

[45] Date of Patent: Aug. 21, 1984

[54] INTEGRATED ELECTRONIC CONTROLLED DIODE FILTER MICROWAVE NETWORKS

[75] Inventors: Morris Cohen, Oceanside, N.Y.; Leon M. Underkofler, Santa Clara, Calif.

[73] Assignee: Loral Corporation, Yonkers, N.Y.

[21] Appl. No.: 410,607

[22] Filed: Aug. 23, 1982

[51] Int. Cl.[3] ..... H01P 1/20; H01P 1/203; H01P 1/205

[52] U.S. Cl. ..... 333/202; 333/203; 333/205; 333/219

[58] Field of Search ..... 333/101, 103–104, 333/110, 116, 132, 134, 202–212, 219–223, 258, 262, 246–247

[56] References Cited

U.S. PATENT DOCUMENTS

| | | | |
|---|---|---|---|
| 2,934,658 | 4/1960 | Lewis | 333/258 |
| 3,559,108 | 1/1971 | Seidel | 333/103 |
| 4,004,257 | 1/1977 | Geissler | 333/206 X |
| 4,316,159 | 2/1982 | Ho | 333/116 X |
| 4,331,942 | 5/1982 | Matsunaga et al. | 333/246 X |
| 4,375,054 | 2/1983 | Pavio | 333/116 |

OTHER PUBLICATIONS

Jones and Bolljahn, "Coupled-Strip-Transmission Line Filters and Directional Couplers", PGMTT, Apr. 1, 1956; pp. 75–81.

*Primary Examiner*—Marvin L. Nussbaum
*Attorney, Agent, or Firm*—Charles E. Temko

[57] ABSTRACT

The disclosure relates to improved filter networks for use in the microwave region employing TTL logic and capable of changing a network from a "bandpass state" to an "all-stop state", or an "all pass state", or from a "low-pass state" to an "all pass state". Provision is also made for the increase or decrease in the selectivity of a low-pass filter.

5 Claims, 18 Drawing Figures

2-SECTION BANDPASS NETWORK

DIODES FORWARD BIASED

2-SECTION ALL-STOP NETWORK

DIODES REVERSE BIASED

LOW PASS NETWORK
(4 SECTIONS)

DIODES FORWARD BIASED

ALL PASS NETWORK

DIODES REVERSE BIASED

BANDPASS NETWORK
(3 SECTIONS)

DIODES REVERSE BIASED

ALL-STOP NETWORK

DIODES FORWARD BIASED

BANDPASS NETWORK

BANDPASS NETWORK

ALL-PASS NETWORK

ALL-PASS NETWORK

F = FORWARD BIASED
R = REVERSE BIASED
C = dc BLOCKING CAPACITOR

INTEGRATED ELECTRONIC CONTROLLED DIODE FILTER MICROWAVE NETWORKS

BACKGROUND OF THE INVENTION

This invention relates generally to the field of microwave transmission, and more particularly to integrated electronic controlled diode filter networks for use in the microwave region which are capable of being adjusted to substantially change the filter characteristics thereof during operation. While the invention has many practical applications, it is particularly suited to the structures of filter multiplexing networks, switch-filter-switch matrices, sampling networks, amplifiers, and similar applications.

The techniques related to devices of this type have been substantially explored[1]. The principal problem with devices of this type lies in the fact that once designed and constructed, they are inherently non-adjustable with respect to the degree of transmission bandpass width, and the like. Where such adjustment is required, it is necessary to provide similar networks with different characteristics of transmission which are selectively switched into and out of the circuits with which they are associated.

[1]See Jones, E. M. T. and Bolljahn, J. T. "Coupled-Strip-Transmission-Line Filters and Directional Couplers, PGMTT, April, 1956 pp. 75–81.

SUMMARY OF THE INVENTION

Briefly stated, the invention contemplates the provision of an improved diode filter network which is capable, using TTL logic of changing the operational characteristics of the network, for example, from a "bandpass state" selectively to an "all-stop state", or an "all pass state"; or from a "low-pass state" to an "all-pass state". It is also possible to increase or decrease the selectivity of a low-pass filter using the inventive construction.

In essence, the invention involves the use of switching diodes, affixed to one or more of the filter conductors forming a network which are electronically altered from one state to another, e.g. bandpass to all pass. The basic microwave structures to be described in the present disclosure are of the parallel resonator type, commonly used in stripline, suspended substrate and microstrip media. The combline configuration can also be used in terms of altering a bandpass network to an all-stop network.

BASIC PHYSICAL GEOMETRY AND OPERATION

At this point in the disclosure, it should be noted that a diode, the cathode of which is connected to ground will appear as a very low resistance approximating a short circuit, when forwardly biased. The same diode will appear as a high capacitative reactance approximating an open circuit when reverse biased. Typical switching diode parameters for the microwave region as R=2–3 ohms; C=0.02 pf.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENTS

Figure 1A:
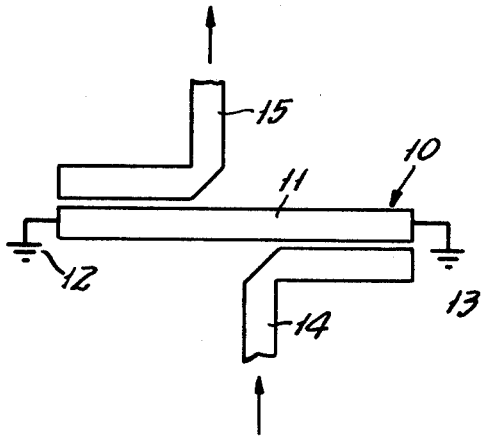
FIG. 1A. (PRIOR ART)
FIG. 1A is a schematic diagram of a typical two-section bandpass network, in accordance with the prior art.

Referring to FIG. 1A in the drawing, there is disclosed a typical two-section bandpass network of known type, generally indicated by reference character 10, and including a center conductor 11 having ground connections 12 and 13 and input and output conductors 14 and 15, respectively.

Figure 1B:
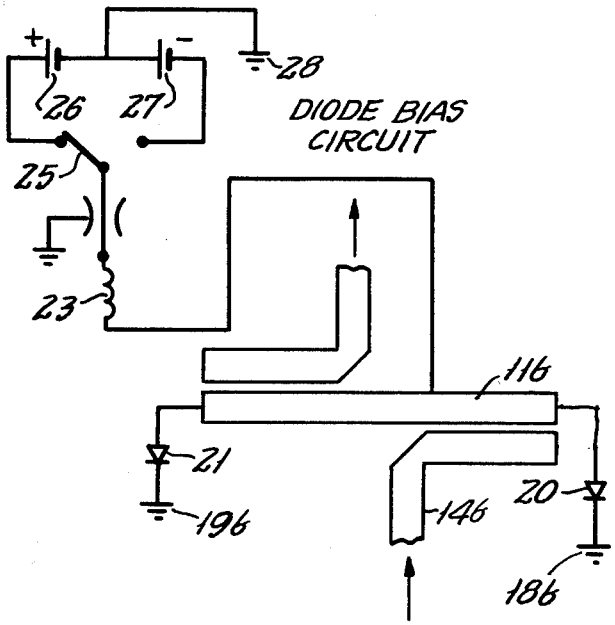
FIG. 1B is a schematic representation of structure equivalent to FIG. 1A, and embodying the invention.

Referring to FIG. 1B, the equivalent structure is found which is capable of providing both bandpass and all-stop functions. It includes the structure shown in FIG. 1A, but in addition, the input conductor **14*b* is provided with a diode 20, and the central conductor 11*b* is provided with a diode 21 for selective communication with ground at 18 and 19. The biasing of the diodes in a forward or reverse direction is illustrated in FIG. 1B, and it will be understood that all of the remaining embodiments described in this specification are provided with similar circuitry to enable the diodes to be forwardly or rearwardly biased as required. In each case, the diode biased circuit will include an rf choke 23, a switch 25, which is preferably electronically actuated, directional sources of current 26 and 27 and a common ground 28**.

Figure 1C:
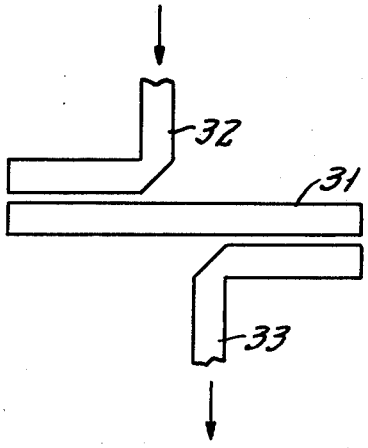
FIG. 1C. (PRIOR ART)
FIG. 1C is a schematic representation of a known two-section all-stop network.
Figure 1D:
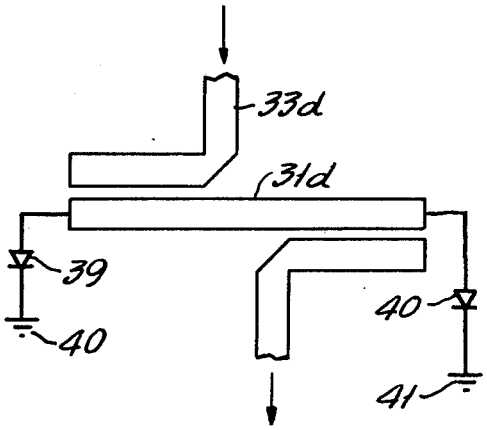
FIG. 1D is a schematic representation of structure equivalent to FIG. 1C, and embodying the invention.

FIG. 1C illustrates a known two-section all-stop network, including a center conductor 31, input conductor 32, and output conductor 33, none of which are grounded. FIG. 1D illustrates this structure with a first diode 39 connected to the center conductor 31, a second diode 40 being connected to the output conductor 33 with serial connection to ground at 41 and 42.

Figure 2A:
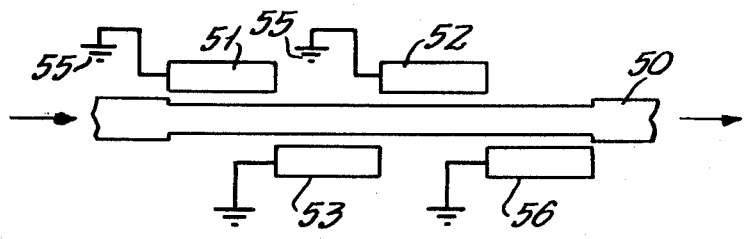
FIG. 2A. (PRIOR ART)
FIG. 2A is a schematic diagram of a typical low-pass network, in accordance with the prior art.
Figure 2B:
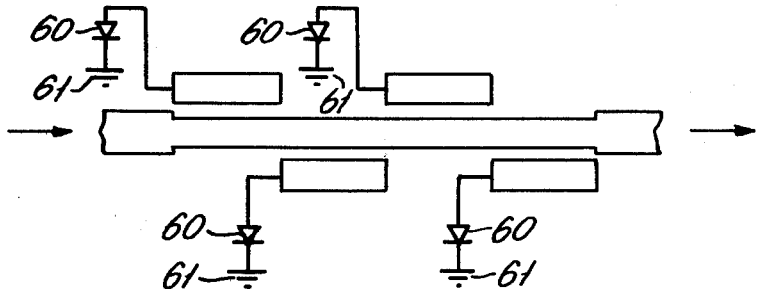
FIG. 2B is a schematic diagram of structure equivalent to FIG. 2A, and embodying the invention.

FIG. 2A schematically illustrates a known low-pass network, including a central conductor 50, and four resonators 51, 52, 53, and 54, each having its ground connection at 55. FIG. 2B shows the equivalent structure, with each of the ground connections being provided with a diode 60 communicating with ground at 61.

Figure 2C:
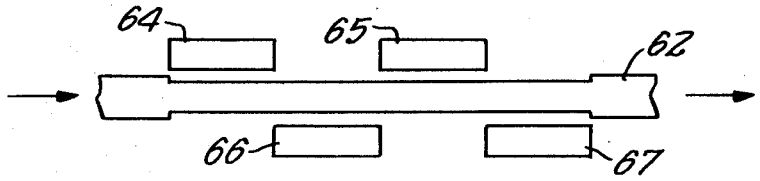
FIG. 2C. (PRIOR ART)
FIG. 2C is a schematic diagram of a known all-pass network.
Figure 2D:
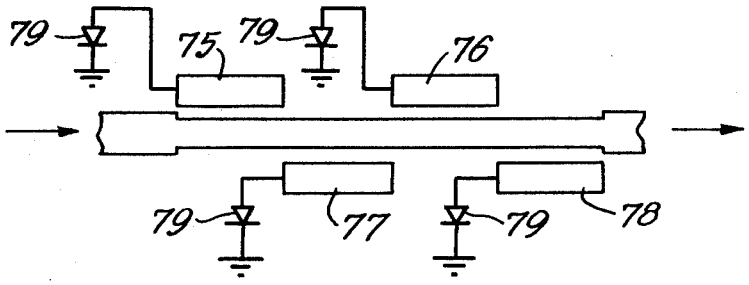
FIG. 2D is a schematic representation of an all-pass network similar to that seen in FIG. 2C, but embodying the invention.

FIG. 2C illustrates a known all-pass network 62 with nongrounded resonators 64, 65, 66, and 67. FIG. 2D illustrates the combining of the functions of the structures shown in FIGS. 2A and 2C into a single structure, generally indicated by reference character 68, in which the resonators 69, 70, 71, and 72 of FIG. 2C are duplicated by resonators 75, 76, 77, and 78, and provided with diode 79 to ground. In essence, this structure is similar to that shown in FIG. 2B, with the diodes reverse biased.

Figure 3A:
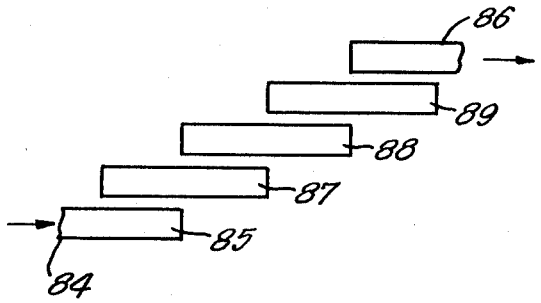
FIG. 3A. (PRIOR ART)
FIG. 3A is a schematic representation of a cascade type bandpass network of known type.
Figure 3B:
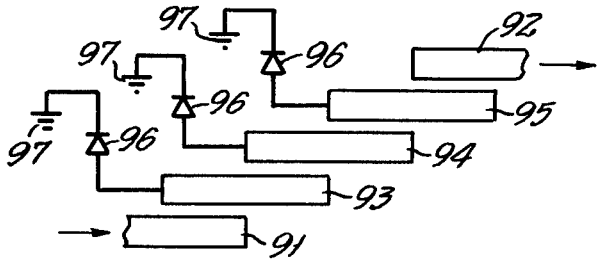
FIG. 3B is a schematic diagram showing structure equivalent to that seen in FIG. 3A, and embodying the invention.

FIG. 3A shows a cascade type bandpass network of three-section type, in which the network, generally indicated by reference character 84, includes an input conductor 85, an output conductor 86, and three cascaded resonators 87, 88, and 89. Referring to FIG. 3B, the equivalent construction includes an input conductor 91, an output conductor 92, and resonators 93, 94, and 95, each being provided with a diode 96 connected in series to ground at 97.

Figure 3C:
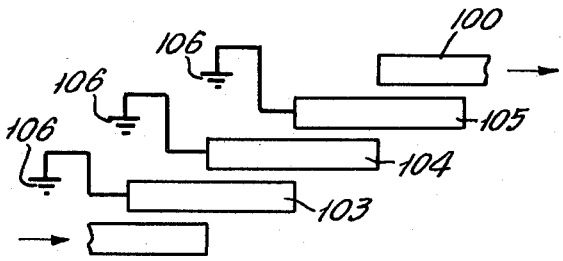
FIG. 3C. (PRIOR ART)
FIG. 3C is a schematic representation of a known all-stop network.
Figure 3D:
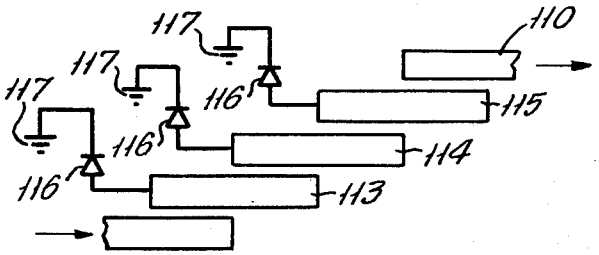
FIG. 3D is a schematic diagram showing stucture equivalent to that seen in FIG. 3C, and embodying the invention.

FIG. 3C shows the equivalent structure of 3A with grounded resonators to form an all-stop network, generally indicated by reference character 100. Here, each of the resonators 103, 104, and 105 is connected directly to ground at 106. FIG. 3D shows the equivalent structure, generally indicated by reference character 110, in which the resonators 113, 114, and 115, are each provided with a diode 116 leading to ground at 117.

Figure 4A:
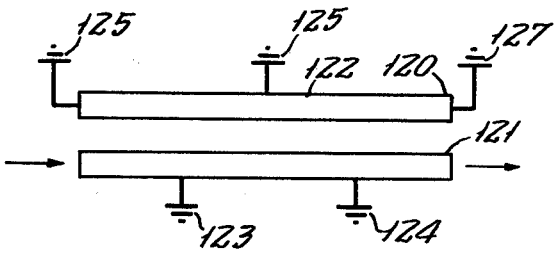
FIG. 4A. (PRIOR ART)
FIG. 4A is a schematic diagram showing a third form of known bandpass network.

FIG. 4A illustrates another type of known bandpass network, generally indicated by reference character 120. It includes a central conductor 121 and parallel resonator 122. The central conductor is grounded at 123 and 124, while the resonator 122 is grounded at 125, 126, and 127. In the equivalent structure shown in FIG. 4B, generally indicated by reference character 130, both the central conductor 131 and resonating conductor 132 are formed with gaps to provide separate grounded sections. The central conductor 131 includes first, second and third sections 134, 135, and 136, with first and second gaps 138 and 139. Grounding points 140 and 141 are fed through diodes 142 and 143. The resonating conductor 132 includes first, second, third, fourth, and fifth sections 145, 146, 147, 148, and 149, separated by first, second, third, and fourth gaps 150, 151, 152, and 153, respectively. Grounding points 154, 155, 156, 157, and 158 communicate through diodes 159, 160, 161, 162, and 163. Different bands are passed by forwardly or rearwardly biasing the diodes as indicated in the drawing.

Figure 4B:
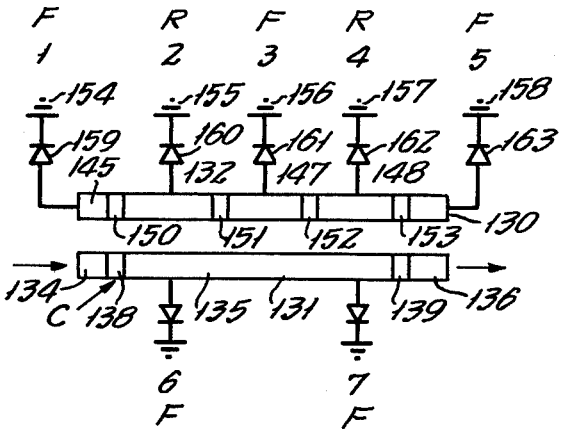
FIG. 4B is a schematic diagram showing structure equivalent to that seen in FIG. 4A, and embodying the invention.
Figure 4C:
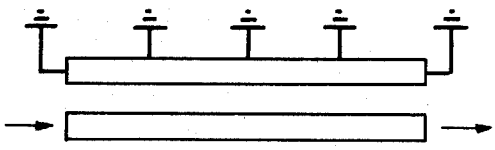
FIG. 4C. (PRIOR ART)
FIG. 4C is a schematic diagram showing a known form of all-pass network.
Figure 4D:
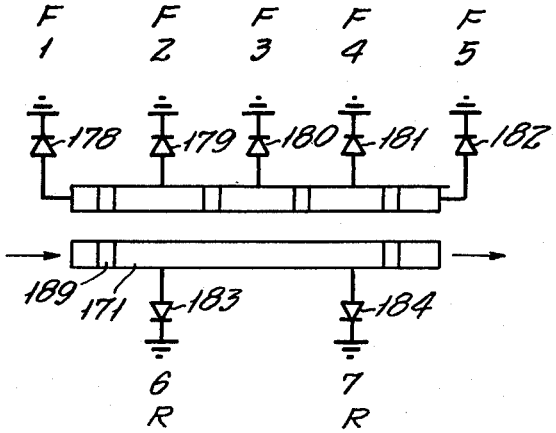
FIG. 4D is a schematic diagram showing structure equivalent to that seen in FIG. 4C, and embodying the invention.

FIG. 4A illustrates a known all-pass network which is constructed similarly to the network seen in FIG. 4B. For all-pass function, the diodes 178, 179, 180, 181, and 182, are forwardly biased, while the diodes 183 and 184 on the central conductor 171 are rearwardly biased. As is the case in the structure disclosed in FIG. 4B, the gap 189 is provided with a dc blocking capacitor.

Figure 5:
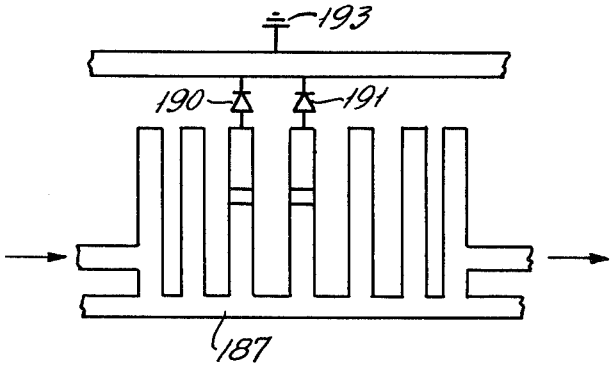
FIG. 5 is a schematic diagram showing another form of bandpass filter diode network for combined bandpass and all-stop operation embodying the invention.

FIG. 5 illustrates a combline bandpass filter-diode network for bandpass and all-stop operation. In this network, generally indicated by reference character 185 a combline conductor 187 includes certain "tines" which are provided with gaps for capacitance, and the diodes 190 and 191 connected therewith connect directly with the resonator 192, which in turn is connected to ground at 193. Here again, in the reverse bias mode, the structure behaves as a bandpass filter. In the forward bias condition, the structure functions as an all-stop network.

In all of the structures illustrated embodying the invention, the resonators which have diodes affixed at the ends thereof must be compensated e.g. foreshortened to offset the effect of the capacitance of the associated diode.

EXPERIMENTAL VERIFICATION

Figure 6:
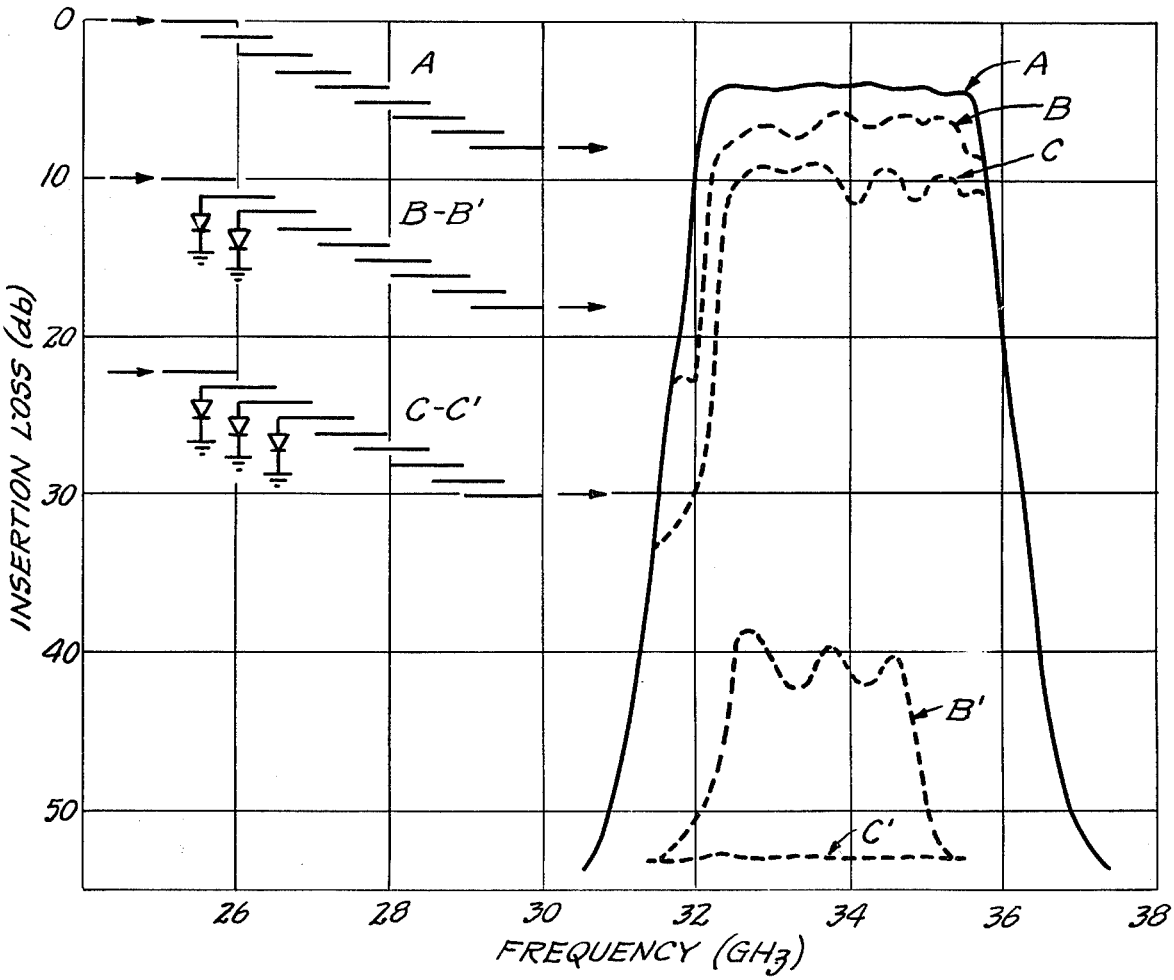
FIG. 6 is a graph showing measured performance of microstrip bandpass filter and filter-diode combinations described in the specification.

In order to test the validity of the described structures, a seven-section microstrip bandpass filter similar to that illustrated in FIG. 3A was designed, fabricated, and tested. The filter was designed for a 32 GHz to 36 GHz passband. Experiments were then made using two diodes, one on each of the first two resonators, and then three diodes, one on each of the first three resonators. The measured performance data illustrated in FIG. 6 where curve A is the response of the filter with no diodes present in the structure. Curve B is the response of the filter with a diode affixed to each of the first two resonators with the diodes in the reverse bias mode. Curve B' is the same condition as B with diodes in the forward bias mode. The response is attenuated to approximately a 40 db level. Curve C is the response of the filter with a diode affixed to each of the first three resonators with the diodes in the reverse bias mode. Curve C' is the response obtained as in curve C with the diodes in the forward bias mode. Here the response is attenuated to a level below 50 db.

It should be noted that responses B and C are slightly distorted and lower in amplitude than A. This is due to the fact that the resonators were not compensated to take into account the diode capacitance. However, the measured results verify the design premise.

We wish it to be understood that we do not consider the invention limited to the precise details of structure shown and set forth in this specification, for obvious modifications will occur to those skilled in the art to which the invention pertains.

We claim:

1. An improved integrated electronic controlled diode filter microwave network comprising: at least one pair of inductively coupled transmission lines, one of said lines transmitting a microwave signal, and the other of said lines being disposed adjacent said first line, said signal being induced in said second line; means including a diode for effectively grounding said second conductor when forwardly biased and effectively disconnecting said grounding connection when said diode is rearwardly biased, whereby said construction may serve different functions depending upon the state of bias of said diode and means for controlling the direction of bias of said diode including an rf choke, a switch, directional sources of current and a common ground; both said pair of transmission lines being connected through diodes to ground.

2. A construction in accordance with claim 1, further characterized in the provision of plural second transmission lines, each being connected through diodes to ground.

3. A construction in accordance with claim 2, further characterized in second conductors being disposed in cascaded arrangement.

4. A construction in accordance with claim 1, further characterized in said pair of transmission lines each having capacitive gaps therein forming individual sections of said conductors, said individual sections each being connected through a diode to ground.

5. A construction in accordance with claim 1, in which said first conductor is a combline form and said diodes are placed in series between said first and second conductors.

* * * * *